US007942286B2

(12) United States Patent
Shiffer et al.

(10) Patent No.: US 7,942,286 B2
(45) Date of Patent: May 17, 2011

(54) CONTAINER LID ARRANGEMENT

(75) Inventors: David A. Shiffer, Irwin, OH (US); David O. Allen, Hillsboro, OH (US)

(73) Assignee: Tech II, Inc., Springfield, OH (US)

( * ) Notice: Subject to any disclaimer, the term of this patent is extended or adjusted under 35 U.S.C. 154(b) by 639 days.

(21) Appl. No.: 11/805,611

(22) Filed: May 24, 2007

(65) Prior Publication Data

US 2008/0290091 A1 Nov. 27, 2008

(51) Int. Cl.
*B65D 17/34* (2006.01)

(52) U.S. Cl. ..... 220/270

(58) Field of Classification Search ..... 220/270, 220/276, 266, 212.5, 212, 265, 260, 254.3, 220/254.1, 258.2, 258.1, 712, 711, FOR. 203, 220/703, 694, 200; 215/257, 250, 305, 295, 215/255, 254, 200, 256, 253, 228; D9/518, D9/416, 901, 435, 438; 222/153.07, 153.06, 222/153.05, 541.9, 541.6, 541.1
See application file for complete search history.

(56) References Cited

U.S. PATENT DOCUMENTS 2,705,085 A * 3/1955 Glensky ..... 215/249
2,978,140 A * 4/1961 Walsh ..... 220/270
3,084,835 A * 4/1963 Walsh ..... 222/541.9
3,142,412 A * 7/1964 Blakeslee ..... 220/270
3,172,558 A * 3/1965 Wilkinson ..... 220/270
3,184,096 A * 5/1965 Cheeley ..... 220/260
3,200,985 A * 8/1965 Ashley ..... 220/270
3,335,899 A * 8/1967 Dunn ..... 220/270
3,734,333 A * 5/1973 Foss ..... 215/255
4,030,630 A 6/1977 Yealy
4,434,908 A * 3/1984 French ..... 220/276
4,467,938 A 8/1984 Allen
4,682,702 A * 7/1987 Gach ..... 222/541.9
D305,734 S 1/1990 Allen
4,919,313 A * 4/1990 O'Brien ..... 222/541.1
D320,560 S * 10/1991 Allen ..... D9/438
5,511,679 A * 4/1996 Beck ..... 220/270
5,806,710 A * 9/1998 Shiffer et al. ..... 220/785

* cited by examiner

*Primary Examiner* — Anthony Stashick
*Assistant Examiner* — Robert J Hicks
(74) *Attorney, Agent, or Firm* — Maginot, Moore & Beck

(57) ABSTRACT

A lid arrangement for a container comprises a peripheral portion surrounding an integrally formed central portion. A first scored portion defines a boundary between the central portion and the peripheral portion. A second scored portion is also formed in the central portion. The second scored portion extends substantially parallel to the first scored portion and a strip is formed in the central portion between the first scored portion and the second scored portion. A tab member is connected to the strip of the central portion. The tab member includes a handle that protrudes from the upper surface of the central portion. When a threshold force pulls the handle of the tab member away from the central portion, the strip separates from the peripheral portion along the first scored portion.

18 Claims, 3 Drawing Sheets

CONTAINER LID ARRANGEMENT

FIELD

This invention relates to the field of container closures, and particularly re-closable container lids.

BACKGROUND

Re-closable container lids are used to allow a user to access the contents of a container and then re-seal the container. These re-closable container lids are used in numerous industries and applications, and are commonly found in the food packaging industry. Numerous variations of re-closable container lids have been utilized in the past.

One commonly used container lid is a two-part lid which includes a first member that mounts on a container and a second member that mounts on the first member. The first member typically includes a peripheral portion and a removable central portion. The peripheral portion is generally fixed to the rim of the cardboard or metal container. The central portion is removably secured to the peripheral portion. The second member includes a lip that engages the peripheral portion of the first member. In this arrangement, the peripheral portion and central portion act to provide an air-tight seal for the container before the central portion is removed.

When the user wishes to open the above-described container, the second member is removed from the first member, leaving the first member on the container. The user then proceeds to remove the central portion from the peripheral portion of the first member to expose the contents of the container. Thereafter, when the user wishes to close the container, the second member is placed again on the peripheral portion of the first member. This second member thus provides a lid for the container after the initial seal is broken when removing the central portion of the first member.

The above-described two-part container lids have, in certain situations, provided satisfactory operation. However, in other situations, such two-part lids have encountered some difficulties. For example, in some two-part container lid arrangements, more force has been required to remove the central portion from the peripheral portion than many consumers are comfortable providing. In addition, in some arrangements, the means provided to remove the central portion from the peripheral portion have been awkward or easily damaged when attempting removal of the central portion. In these situations, removal of the central portion is difficult, resulting in frustration of the consumer. In other arrangements, the user has been required to force his or her fingers through the central portion and into the container in order to remove the central portion. This can be problematic if the user contacts the contents of the container. For example, if the contents of the container are a liquid, the user's fingers may contact the liquid, making the process of opening the container a messy task for the consumer while also contaminating the contents of the container.

Accordingly, it would be desirable to provide a two-part lid arrangement where the central portion is easily removed from the peripheral portion of the first lid member with little risk of damage to the removal means. In addition, it would be desirable to provide a lid arrangement where little force is required by the user to remove the central portion from the peripheral portion of the first member. Furthermore, it would be desirable to provide a two-part lid arrangement where the user is not required to place his or her finger into the container when removing the central portion from the peripheral portion of the two-part lid arrangement.

It would be desirable to provide a lid arrangement that provides one or more of the above or other advantageous features as may be apparent to those reviewing this disclosure. In any event, the teachings disclosed herein extend to those embodiments which fall within the scope of the appended claims, regardless of whether they accomplish one or more of the above-mentioned advantages.

SUMMARY

A lid arrangement for a container is disclosed herein. In at least one embodiment, the lid arrangement comprises a peripheral portion surrounding an integrally formed central portion having an upper surface and a lower surface. A first scored portion defines a boundary between the central portion and the peripheral portion. A second scored portion is also formed in the central portion. The second scored portion extends substantially parallel to the first scored portion and a strip is formed in the central portion between the first scored portion and the second scored portion. A tab member is connected to the strip of the central portion. The tab member includes a handle that protrudes from the upper surface of the central portion. When a threshold force pulls the handle of the tab member away from the central portion, the strip separates from the peripheral portion along the first scored portion.

In one embodiment, the tab member comprises a thumb platform rising from the upper surface of the central portion. The thumb platform comprises a first sidewall portion and a second sidewall portion which meet at a tip of the thumb platform. The tip of the thumb platform is adjacent to the first scored portion. The second scored portion extends about the thumb platform along the second sidewall portion but does not extend along the first sidewall portion of the thumb platform. In this arrangement, the end of the second scored portion terminates at the first scored portion at the tip of the thumb platform.

Accordingly, a user may open a container with the lid arrangement by grasping the handle on the lid and pulling the handle away from the central portion. When the handle is pulled away from the central portion, one side of the strip is torn away from the peripheral portion and an opposite side of the strip is torn away from the remaining part of the central portion. By continuing to pull the handle and the connected strip away from the container, the use may completely remove the central portion of the lid from the peripheral portion of the lid.

The above described features and advantages, as well as others, will become more readily apparent to those of ordinary skill in the art with reference to the following detailed description and accompanying drawings.

DESCRIPTION

Figure 1:
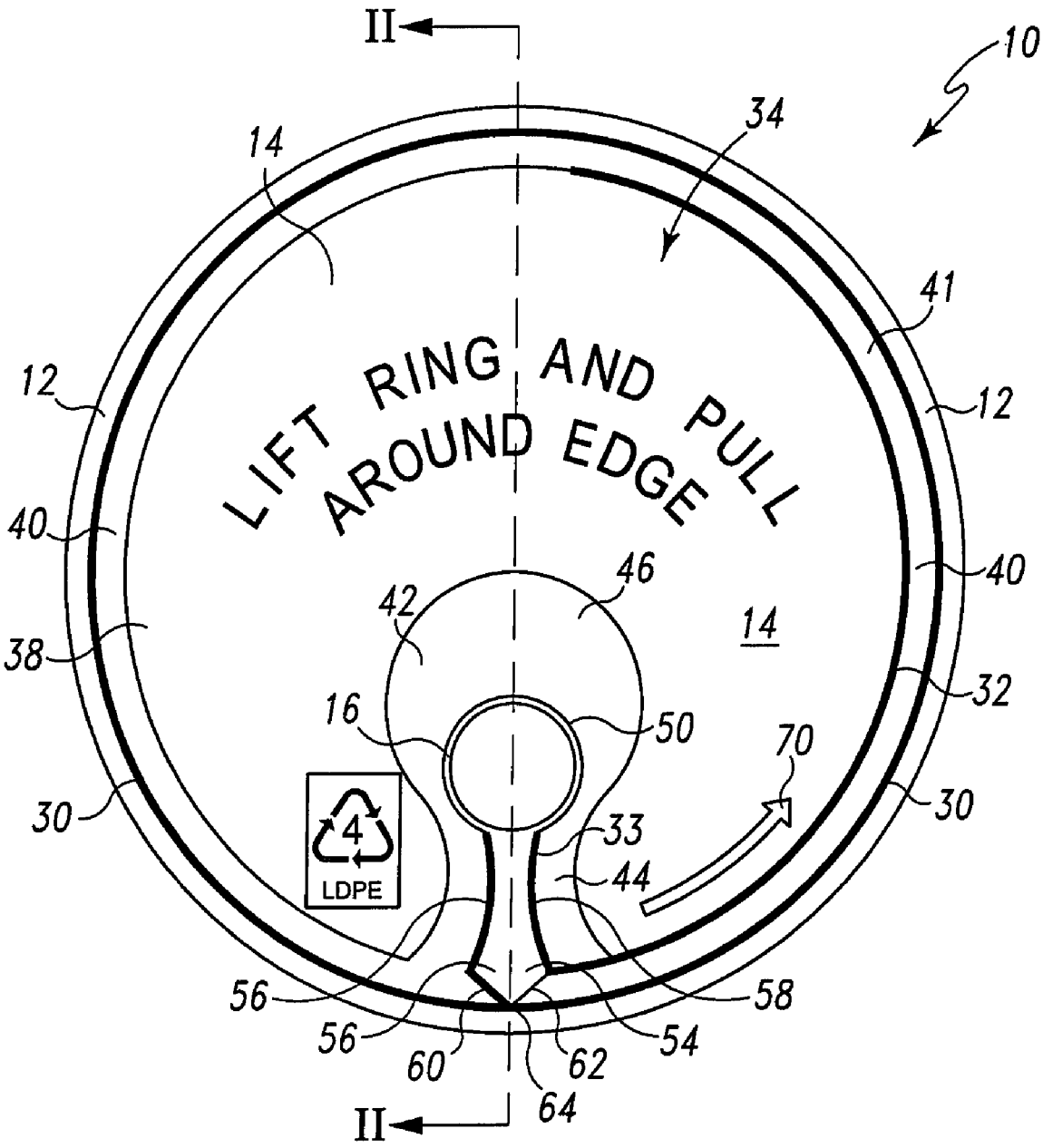
FIG. 1 shows a top view of one embodiment of a lid arrangement.

An exemplary embodiment of a lid arrangement for a container is shown in FIG. 1. The lid arrangement 10 comprises a peripheral portion 12 surrounding a central portion 14. A tab member 16 is provided on the central portion 14. As explained below, the tab member 16 is used to remove the central portion 14 from the peripheral portion 12.

The peripheral portion 12 is generally designed to fit around the rim of an associated container. In the embodiment of FIGS. 1-4, the peripheral portion is ring-shaped. The peripheral portion includes an outer lip 22 and an inner wall 24, and an upper ridge 26. The lip 22, ridge 26, and wall 24 define an annular channel 28. As shown in FIG. 3, this annular channel 28 is configured to receive the rim 19 of a container 18, allowing the peripheral portion 12 of the lid arrangement to rest on the container rim 19. The peripheral portion 12 may be secured to the container rim, such as through adhesives, providing an air-tight seal between the container 18 and the peripheral portion 12. One of skill in the art will recognize that the peripheral portion may also be secured to the container in numerous other ways.

The peripheral portion 12 is designed to engage a cover member 20. In particular, as shown in FIG. 3, the cover member 20 fits over the peripheral portion 12 and provides a lid over the peripheral portion and the associated container 18. The cover member 20 may be secured to or removed from the peripheral portion 12, as desired by the user.

Figure 2:
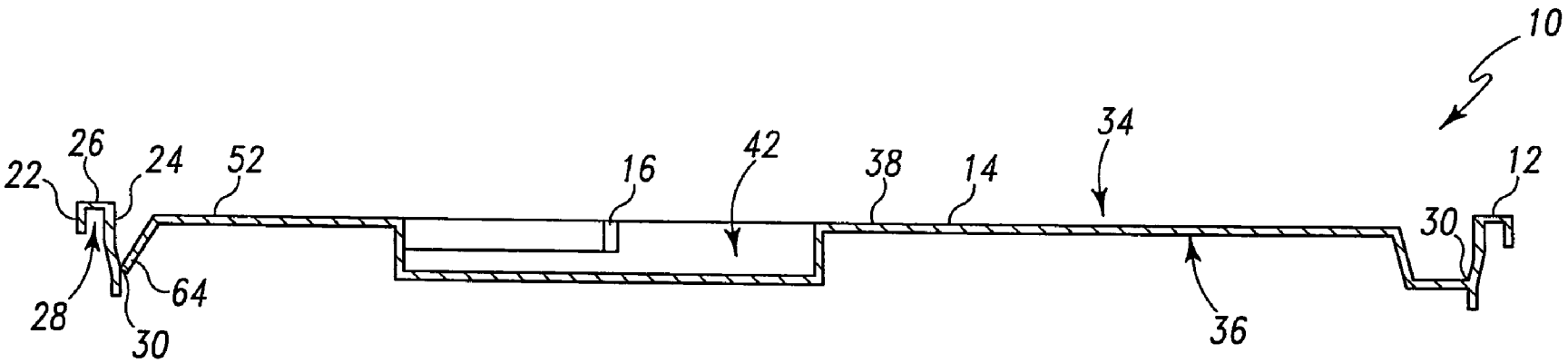
FIG. 2 shows a cross-sectional view of the lid arrangement of FIG. 1 along line II-II.
Figure 3:
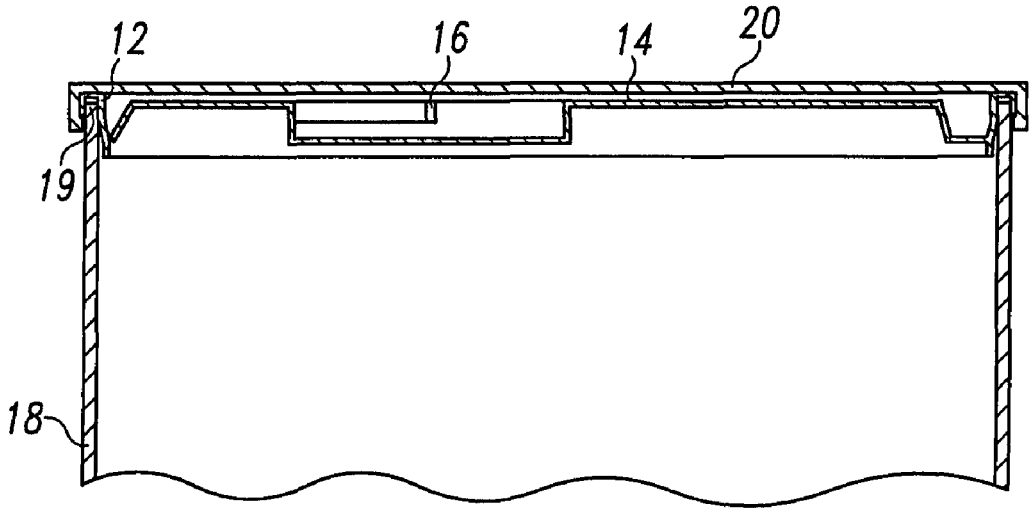
FIG. 3 shows the cross-sectional view of the lid arrangement of FIG. 2 arranged on a container with a top cover.
Figure 4:
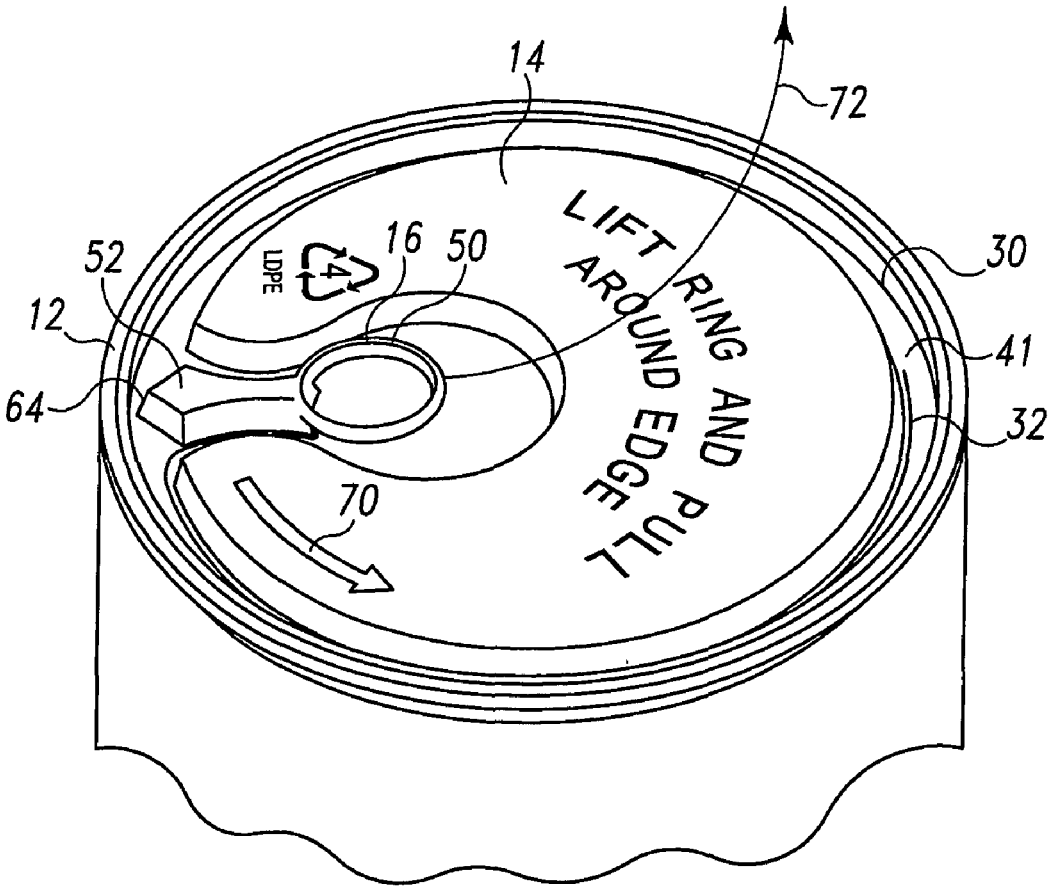
FIG. 4 shows a perspective view of the lid arrangement of FIG. 1 arranged on a container.

With particular reference to FIGS. 1 and 2, the peripheral portion 12 is shown integrally formed with the central portion 14. The central portion 14 generally comprises a thin substantially planar sheet having a substantially greater width and depth than height. One of skill in the art will recognize that the peripheral portion 12 and central portion 14 may be formed in various fashions by any of various materials. In one embodiment, the lid arrangement 10 is molded as a single integral piece of low density polyethylene. However, those of skill in the art will recognize that the lid arrangement may also be comprised of other materials, including other plastics and metal materials, depending on the desired application and associated container.

The central portion 14 includes an upper surface 34 and a lower surface 36. In the embodiment of FIGS. 1-4, the central portion 14 is disc-shaped. However, the central portion 14 may also be various other shapes to match the associated peripheral portion 12 and the container 18. The upper surface of the central portion 14 includes a main raised portion 38, a sunken strip channel 40 and sunken tab slot 42, wherein the surface defining the strip channel 40 and tab slot 42 lie in a different plane than the main raised portion 38. The strip channel 40 extends around the perimeter of the central portion 14, adjacent to the peripheral portion 12. The tab slot 42 has a generally hourglass shape and includes a neck 44 that leads from the strip channel 40 to a head 46 of the tab slot 42.

A first scored portion 30 is provided in the strip channel 40 and defines a boundary between the peripheral portion 12 and the central portion 14 of the lid arrangement 10. In the embodiment of FIG. 1, the first scored portion 30 is shown as a bold circle bordering the peripheral portion 12.

The first scored portion 30 provides a band on the lid arrangement 10 where the thickness (or "height") of the lid arrangement is reduced in the first scored portion. The thickness of the lid arrangement at the first scored portion is significantly less than the thickness of the central portion 14 directly adjacent to the first scored portion 30. The first scored portion 30 may be provided in numerous ways as will be recognized by those of skill in the art. For example, the first scored portion may comprise an annular groove or elongated notch in the lid arrangement that runs continuously along the peripheral portion. As another example, instead of a continuous groove, the first scored portion 30 may be a perforated stretch on the lid arrangement with a plurality of indentations or notches provided in an annular row. In most embodiments, the indentations or notches will not extend completely through the lid arrangement, but will only provide areas of reduced thickness. In any event, the first scored portion 30 provides an area of reduced strength in the central portion such that a force pulling along the edge of the central portion will result in a tear along the first scored portion.

A second scored portion 32 is also provided in the strip channel 40 generally parallel to the first scored portion, but provided along the opposite side of the strip channel from first scored portion 30. Like the first scored portion 30, the second scored portion 32 is shown in bold in FIG. 1. Also like the first scored portion 30, the second scored portion 32 provides a length on the central portion 14 where the thickness (or "height") of the central portion is reduced such that the thickness of the central portion 14 along the first scored portion is significantly less than the thickness of the central portion 14 directly adjacent to the second scored portion 32. Accordingly, the second scored portion 32 provides an area of reduced strength in the central portion 14 such that a force pulling along the edge of the central portion will tear the central portion along the second scored portion 32.

Unlike the first scored portion 30, the second scored portion 32 extends only partially around the perimeter of the central portion 14. In the embodiment shown in FIG. 1, the second scored portion 32 terminates about half way around the perimeter. For example, the second scored portion 32 may extend to a location about 110° to 250° around the central portion 14. However, in different embodiments, the second scored portion 32 may extend to different angular degrees around the central portion 14.

Together, the first scored portion 30 and second scored portion 32 define a strip 41 in the strip channel 40. When the first scored portion 30 and second scored portion 32 are torn, the strip 41 is torn away from the rest of the central portion 14.

The tab member 16 of the lid arrangement 10 comprises a handle 50 connected to a thumb platform 52. The handle 50 projects outward from the thumb platform 52 into the tab slot 42. In the embodiment of FIG. 1, the handle 50 is a finger ring designed and dimensioned to receive the finger of a human's hand.

The thumb platform 52 provides an island in the middle of the neck 44 of the tab slot 42. The thumb platform 52 includes a top surface 54 that is raised from the floor of the tab slot 44, the top surface 54 provided in a plane close to the plane containing the main raised portion 38 of the central portion 14 of the lid arrangement 10. Two opposing curved sidewalls 56, 58 depend from the top surface 54. Two opposing flat sidewalls 60, 62 are connected to the curved sidewalls. The opposing flat sidewalls 60, 62 meet in a corner which provides a tip 64 for the thumb platform 52. As can be seen in FIG. 1, the shape of the thumb platform 52 is similar to an arrowhead with the tip 64 located at the first scored portion 30 of the lid arrangement.

The handle 50 is connected to the thumb platform near the top surface 54 and opposite the tip 64. The handle 50 projects from the thumb platform 52 out into the tab slot 42 with a distance provided between the handle 50 and the floor of the tab slot 42. This distance allows a user to insert his or her finger under the handle 50 such that the user's index finger may be inserted into the handle from the lower side of the handle. When a user's index finger is placed in the handle, the user's thumb may conveniently be placed on the top surface 54 of the thumb platform. Grasping the tab member 16 in this fashion is advantageous for removing the central portion 14 from the peripheral portion 12, as will be explained in further detail below.

As best seen in FIG. 1, the second scored portion 32 includes an end stretch 33 that extends about the thumb platform 52. In particular, the end stretch 33 of the second scored portion 32 extends along the opposing curved sidewalls 56, 58, including the back portion between the sidewalls (now shown in FIG. 1), and along the first flat sidewall 60 of the two flat sidewalls. The end stretch 33 of the second scored portion 32 then terminates at the first scored portion 30. The second scored portion 32 does not extend along the second flat sidewall 62 of the two flat sidewalls. Instead, the strip 41 is connected to the thumb platform 52 along the second flat sidewall 62.

In operation, a user wishing to access the contents of the container 18 first removes the top cover member 20 from the container 18. The user must then remove the central portion 14 from the peripheral portion 12 to complete the process of opening the container. The user reads the text provided on the upper surface of the central portion 14 which states, "LIFT RING AND PULL AROUND EDGE". An arrow 70 is also provided on the central portion 14 indicating the direction that the user should pull the ring. With these instructions provided, the user inserts his or her index finger under the ring 50 to lift the ring and then places his or her finger through the ring, thus grasping the handle of the lid arrangement 10. At the same time, the user places his or her thumb on the thumb platform. The user's thumb serves as a leverage point, allowing the user to pull up on the ring while the thumb presses down on the thumb platform 52.

When the user provides a threshold upward force on the handle 50, the second scored portion 32 begins to tear around the thumb platform 52. The tip 64 of the thumb platform 52 then punctures the first scored portion 30 as the user presses down on the thumb platform with his or her thumb while pulling up on the handle 50. As the user continues to provide the threshold force, pulling upward on the handle 50 as indicated by the arrow 72 in FIG. 4, the lid arrangement tears along the first scored portion 30 and the second scored portion 32. The tear along the first scored portion 30 and the second scored portion allows the strip 41 to pull away from the peripheral portion. When the strip 41 is torn away to the end of the second scored portion 32, the strip 41 remains attached to the rest of the central portion 14 where the second scored portion ends. However, as the user continues to pull upward on the handle 50, the central portion 14 continues to tear away from the peripheral portion 12 along the first scored portion 30 until the central portion 14 is completely separated from the peripheral portion. In this manner, the user opens the container and may access the contents of the container. When the use wishes to re-close the container 18, the upper cover 20 is placed over the peripheral portion 12 which remains secured to the rim of the container 18.

Although the present invention has been described with respect to certain preferred embodiments, it will be appreciated by those of skill in the art that other implementations and adaptations are possible. Moreover, there are advantages to individual advancements described herein that may be obtained without incorporating other aspects described above. Therefore, the spirit and scope of the appended claims should not be limited to the description of the preferred embodiments contained herein.

What is claimed is:

1. A lid for a container comprising:

a) a peripheral portion;

b) a central portion surrounded by the peripheral portion, a first scored portion defining a boundary between the central portion and the peripheral portion, a second scored portion formed in the central portion and extending from a first score endpoint located on said first scored portion to a second score endpoint spaced apart from said first scored portion, wherein a strip is formed in the central portion between the first scored portion and the second scored portion, and wherein the central portion defines a tab slot having a slot floor; and c) a tab member connected to the strip of the central portion, wherein the strip is configured to separate from the peripheral portion along the first scored portion when a threshold force pulls the tab member away from the central portion, wherein the tab member includes (i) a thumb support structure, and (ii) a handle extending from the thumb support structure, wherein the thumb support structure includes (i) a top surface, (ii) a first lateral sidewall extending from the top surface toward the slot floor, (iii) a second lateral sidewall extending from the top surface toward the slot floor, and (iv) a back wall extending between the first lateral sidewall and the second lateral sidewall, wherein (i) the first lateral sidewall includes a first sidewall segment and a second sidewall segment, and (ii) the second lateral sidewall includes a third sidewall segment and a fourth sidewall segment, wherein (i) the back wall is interposed between the first sidewall segment and the third sidewall segment, and (ii) the second sidewall segment and the fourth sidewall segment meet to form a tip that is located at the first score endpoint, wherein the second scored portion extends in a path sequentially from the first score endpoint, along the first sidewall segment, along the second sidewall segment, along the back wall, along the third sidewall segment, and along the strip to the second score endpoint, and wherein said fourth sidewall segment is connected to said strip.

2. The lid of claim 1 wherein the first scored portion is perforated.

3. The lid of claim 1 wherein the peripheral portion defines a channel configured to receive a rim of a container.

4. The lid of claim 3 further comprising a cover member configured to mount to the peripheral portion and cover the peripheral portion and the central portion.

5. The lid of claim 1 wherein the handle comprises a ring extending from the thumb support structure into the tab slot.

6. The lid of claim 1 wherein the first scored portion extends completely around a perimeter of the central portion and the second scored portion extends a shorter distance than the first scored portion.

7. The lid of claim 1, wherein:

(i) said first sidewall segment includes a first curved sidewall, and (ii) said second sidewall segment includes a first flat sidewall, (i) said third sidewall segment includes a second curved sidewall, and (ii) said fourth sidewall segment includes a second flat sidewall, and the first flat sidewall and the second flat sidewall meet to form the tip.

8. The lid of claim 7, wherein the second scored portion extends in a path sequentially from the first score endpoint, along the first flat sidewall, along the first curved sidewall, along the back wall, along the second curved sidewall, and along the strip to the second score endpoint.

9. The lid of claim 8, wherein the second flat sidewall is connected to the strip.

10. The lid of claim 7, wherein the back wall extends between the first curved sidewall and the second curved sidewall.

11. The lid of claim 7, wherein at least a portion of the second scored portion is located in the tab slot.

12. The lid of claim 1, wherein:

the second scored portion extends X° around the central portion, and $110° \leqq X \leqq 250°$.

13. The lid of claim 7, wherein the central portion is integrally formed with the peripheral portion.

14. The lid of claim 7, wherein the handle extends from the top surface of the thumb support structure.

15. The lid of claim 7, wherein the handle is spaced apart from the slot floor.

16. The lid of claim 7, wherein part of the second scored portion is generally parallel to part of the first scored portion.

17. The lid of claim 1, wherein:

said first sidewall segment and said second sidewall segment are contiguous with each other, and said third sidewall segment and said fourth sidewall segment are contiguous with each other.

18. The lid of claim 1, wherein:

said fourth sidewall segment extends between said first scored portion and said second scored portion along a route, and wherein said second scored portion does not extend along said route from said first scored portion to second scored portion.

* * * * *